US005620185A

United States Patent [19]

Robertson

[11] Patent Number: 5,620,185

[45] Date of Patent: Apr. 15, 1997

[54] RING TOSS GAME

[76] Inventor: Harvey C. Robertson, 112 Hilltop St., Simpsonville, S.C. 29681

[21] Appl. No.: 610,151

[22] Filed: Feb. 29, 1996

[51] Int. Cl.[6] ..... A63B 67/06

[52] U.S. Cl. ..... 273/338; 273/DIG. 30

[58] Field of Search ..... 273/336, 337, 273/338, 339, 350, 424, 425, DIG. 24, DIG. 30; 446/46, 47, 48

[56] References Cited

U.S. PATENT DOCUMENTS

| | | | |
|---|---|---|---|
| 108,587 | 10/1870 | Hale | 273/336 |
| 1,178,049 | 4/1916 | Beardsley . | |
| 1,230,503 | 6/1917 | Miller | 273/336 |
| 1,501,942 | 7/1924 | Carman | 273/339 |
| 1,617,127 | 2/1927 | Levay | 273/339 |
| 1,705,501 | 3/1929 | Sas | 273/339 |
| 3,363,899 | 1/1968 | Gross . | |
| 3,403,907 | 10/1968 | Keller | 273/350 |
| 3,731,930 | 5/1973 | Jeandron . | |
| 3,784,200 | 1/1974 | Hotchkiss . | |
| 4,063,382 | 12/1977 | McCallum | 446/48 |
| 4,305,587 | 12/1981 | O'Grady | 273/345 |
| 4,315,629 | 2/1982 | English | 273/425 |
| 4,906,007 | 3/1990 | Mitchell et al. | 273/425 |
| 4,936,590 | 6/1990 | Palmer | 273/402 |
| 4,940,441 | 7/1990 | Novinsky | 446/46 |
| 4,989,880 | 2/1991 | Gettemeier et al. | 273/336 |
| 5,078,637 | 1/1992 | McFarland | 446/46 |
| 5,421,585 | 6/1995 | Ruvio | 273/338 |

FOREIGN PATENT DOCUMENTS

| | | |
|---|---|---|
| 2225248 | 5/1990 | United Kingdom . |

OTHER PUBLICATIONS

"Flying Casino" Advertisement, Continental Promotions, Inc. Aug. 1978 or Earlier 273–338.

*Primary Examiner*—William H. Grieb
*Attorney, Agent, or Firm*—Hardaway Law Firm, PA

[57] ABSTRACT

A disk game that can be easily carried to different locations and played both on land and in water is disclosed. The game uses a mat of closed cell foam having fastening elements thereon to provide for the quick set up of the targets, also having fastening elements thereon, in the proper position. The game is sold in a container that is element proof and also useable for carrying the game from one place to another, i.e., the container is not destroyed when the product is taken out of the container. Also disclosed is a flying article for use with the disk game. The flying article is modified so that it has both floating ability and improved aerial stability.

4 Claims, 3 Drawing Sheets

RING TOSS GAME

BACKGROUND OF THE INVENTION

Developing games just challenging enough to not be frustrating is a game designer's goal. Often games require so much skill that the ordinary player never wins and becomes frustrated with the game. This causes the longevity and popularity of some games to be very short. One type of game that has developed is the ring toss game. This game requires the player to stand a given number of feet from one or more upstanding targets and throw a flying article with a hole in its center at the one or more targets. The sole goal being to have the upstanding target enter the hole in the article. See, e.g., the Flying Casino Game marketed by Continental Promotions of Minneapolis, Minn. To date, ring toss games have seen varying levels of success due to various flaws inherent in their designs.

Furthermore, ring toss games have not come properly packaged so that they can be easily carried around and taken to different places such as the beach or the park. Traditionally, as shown in the prior art to Winneco Industries and "Flip-n-Fly", removal of the game from its packaging often destroys the packaging. This requires purchasers to obtain some additional container for the game if they desire to carry the game around to different locations.

Furthermore, traditionally, ring toss games have not been adequately designed to be played on differing surfaces such as water in a swimming pool and/or grass in a park. While the Flying Casino game calls itself an "anywhere" game, it certainly does not show features suggesting the game floats and can be played in, e.g., a swimming pool. The floating game found in U.S. Pat. No. 3,403,907 to Keller faces the problems of not being a self-contained, easily transported, game. Also, in Keller, there is only one means of scoring, i.e., getting the missile in the cylinder. This can be monotonous and boring.

Accordingly, there is room for improvement within the art.

OBJECTS OF THE INVENTION

It is an object of the invention to provide a ring toss game that is sufficiently challenging yet not so difficult as to frustrate the player.

It is a further object of the invention to provide a ring toss game in which the player tosses a flying article with a hole at its center at a target having a post suspended above a circular flange.

It is yet a further object of the invention to provide a ring toss game in which the player tosses a flying article with a hole at its center at a plurality of targets with the player receiving different numbers of points based on how the flying article comes to rest with respect to the posts and circular flanges of the various targets.

It is still yet a further object of the invention to provide a ring toss game that can be played virtually anywhere, including in the water at a swimming pool or beach.

It is still yet a further object of the invention to provide a ring toss game that is self-contained and can be easily carried from one location to another.

It is still yet a further object of the invention to provide a ring toss game that is made of materials that can resist the elements and/or are recyclable.

It is still yet a further object of the invention to provide a ring toss game that reduces the probability that the flying article will hang from the tips of the targets.

It is still yet a further object of the invention to provide an improved flying article for use with the ring toss game and having both improved aerial stability and floating ability.

These and other objects of the invention are achieved by a ring toss game comprising: at least one flying article having a hole at its center for throwing by a player; and at least one target, the target comprising: a circular flange having fastening elements for assuring the target remains properly positioned; a post extending upward from the circular flange and having a diameter smaller than that of the hole in the flying article; and a tip on top of the post; whereby a player attempts to position the flying article on the circular flange by throwing the ring-shaped flying article at the target and causing the tip and post to pass through the center of the flying article.

DETAILED DESCRIPTION OF THE INVENTION

With reference to the figures, a ring toss game and improved flying article that meets and achieves the various objects of the invention referred to above will now be described.

Figure 1:
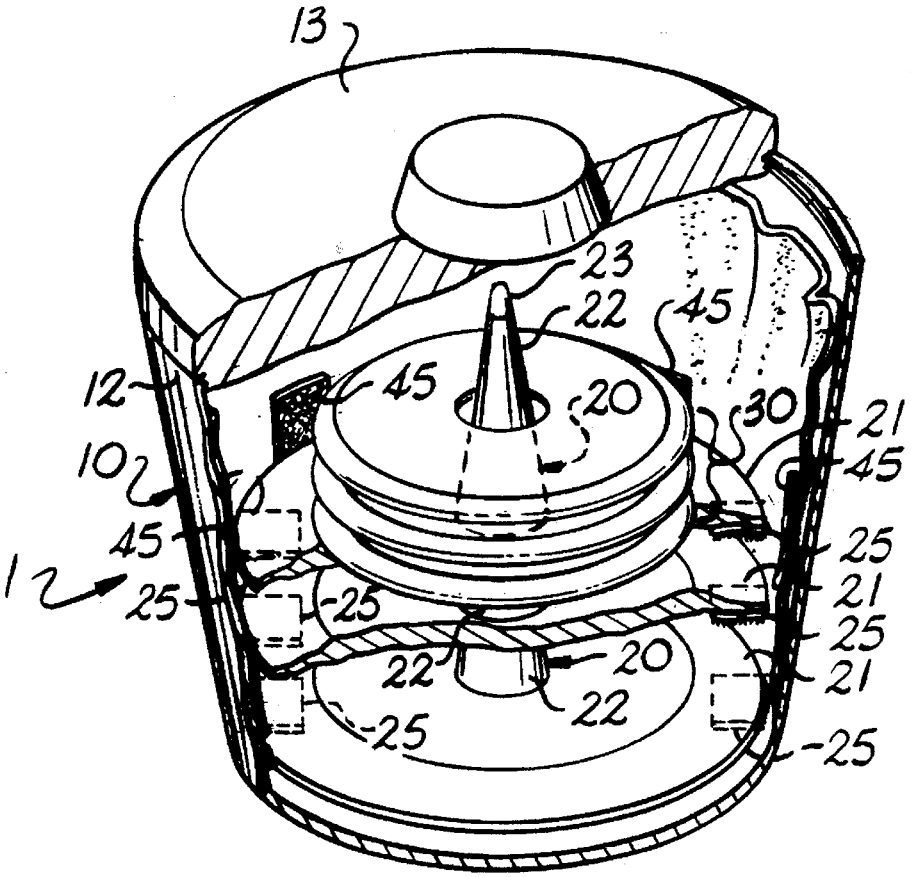
FIG. 1 is a sectional perspective view of a self-contained ring toss game of skill according to the invention.

FIG. 1 shows a self-contained game of skill 1 according to the invention. In FIG. 1, container 10, which comprises bucket 12 and lid 13, is made from a re-usable element resistant material so that the game can be used outdoors, or taken to the beach or pool, etc. This material is preferably recycled or recyclable. Not only is ring toss game 1 sold and marketed in container 10, it is also stored therein. This is an improvement to the prior art packagings described above that must be destroyed to remove the game therefrom. Lid 13 should be a screw-on type lid with a severe pitch so that minimal effort is needed to close container 10, thereby protecting the game components from the elements. As shown in FIG. 1, preferably the diameter of bucket 10 increases towards the top thereof. However, this is not critical for the reasons described below.

Within container 10 are one or more targets 20 made from an element resistant material such as plastic and formed by, for example, blow or injection molding. Typically, there are three targets 20. Each target has a circular flange portion 21 having tapered edges, a post portion 22, and a tip portion 23. Furthermore, post portions 22 are hollow and have a tapering diameter so that they may be nested within each other and stacked as shown in FIG. 1. The bottom of each circular flange 21 has one or more fastening elements 25, in the form of, for example, VELCRO or magnets. The use of these fastening elements 25 will be described below. Tip 23 may come in various forms. For example, tip 23 may be made of a material that can be seen at night without a light so that the ring toss game may be played at night without additional lighting. Further, tip 23 can have numbers thereon for indicating the number of points each target is worth. Even further, tip 23 should be shaped to reduce the possibility that a flying article that hits tip 23 hangs from tip 23 and never drops onto circular flange 21. For example, in the Flying Casino game and U.S. Pat. No. 108,587 to Hale, there is a far greater possibility that their respective flying articles could hang from their respective tips due to their, at least in the case of the Flying Casino game, having a horizontal portion to the tip. For example, I have found that by making tips 23 rounded or semispherical with no narrowed neck portion between tip 23 and post 22, there is a much greater probability the center of a flying article that hits tip 23 will become properly positioned around post 22. This is superior from, for example, U.S. Pat. No. 1,230,503, to Miller, which shows the narrowed neck my invention lacks. Finally, tips 23 may removable from post 22 so that a player may switch among the various tip embodiments just described or the various tip features may be combined and tip 23 made unitary with post 22. Furthermore, it is possible to make the entire target 20 made from a material that can be seen at night without a light, such as a photo luminescent material, so that the ring toss game may be played at night without additional lighting.

Figure 2A:
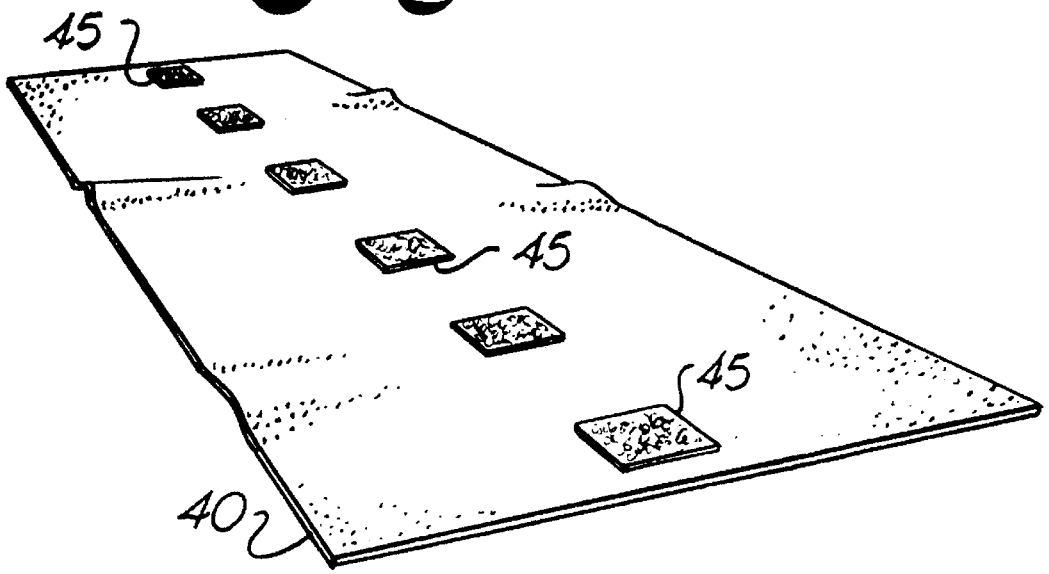
FIGS. 2A and 2B are perspective views showing how the targets of the ring toss game according to the invention are set up.
Figure 2B:
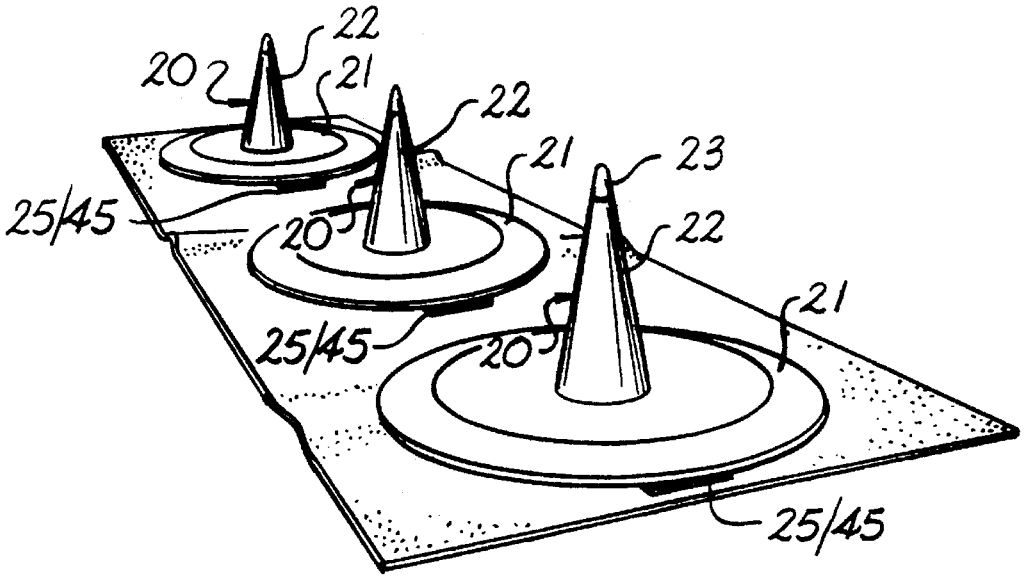
Figure 4:
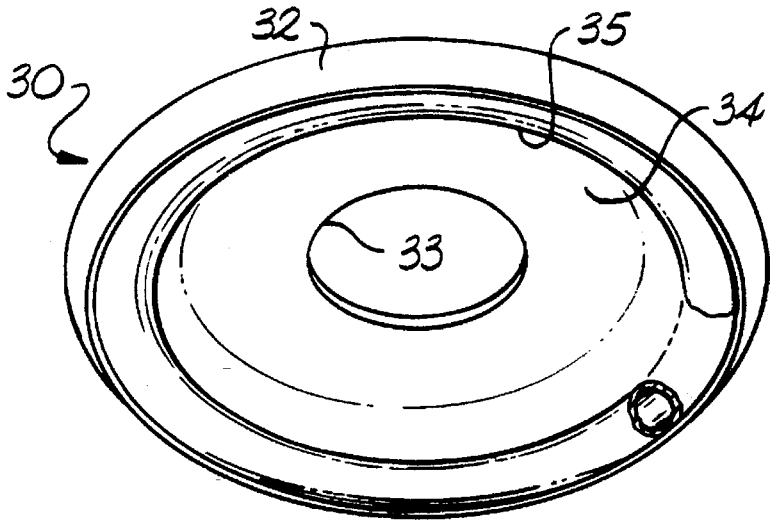
FIG. 4 is a bottom perspective view of an improved flying article for use with the ring toss game according to the invention.

Also within container 10, is mat 40. Mat 40 is also made from an element resistant material that preferably floats so that the game may be played in a pool or at the beach. Closed cell foams that are water impervious are contemplated. Mat 40 should be of a length that, when packaged, it may be wrapped around circular flanges 21 and be positioned between circular flanges 21 and the inner walls of bucket 12. As for this positioning, it may be achieved by either sizing the bucket so that its inner diameter is the thickness of mat 40 greater than the diameter of circular flange 21 or making the bucket have an increasing diameter towards lid 13, as shown in FIG. 1. The fact that there are two approaches of achieving this same goal is why having the diameter of bucket 12 increase towards its lid is not critical. On one side of mat 40 are a series of spaced apart fastening elements 45 complementary to those of target 20. By complementary, I mean that if VELCRO is the contemplated fastener, then fastening element 25 may be the hooks and fastening element 4B the loops (or vice versa). Similarly, if magnets are the contemplated fastener, fastening element 25 may be the magnet and fastening element 45 a piece of magnetic material (or vice versa). Fastening elements 45 are spaced apart a predetermined distance as will be described. As shown in FIG. 2A, when mat 40 is taken out of bucket 12, because it is stored rolled-up within bucket 12, when it is placed on the floor its ends will tend to flex upward. However, as shown in FIG. 2B, when complementary fastening elements 25 and 45 are placed into contact, the weight of targets 20 hold down these upwardly flexed ends, and targets 20 will be spaced apart from each other by the same predetermined distance that fastening elements 45 are spaced apart. Yet also within container 10, are flying articles 30. As shown in FIG. 4, flying article 30 comprises body portion 34, preferably circular, and downwardly directed rim portion 32. Body portion 34 has hole 33 in its center; hole 33 preferably being circular. The smaller hole 33, the higher the skill level needed to play the game. Downwardly directed rim portion 32 is attached to body portion 34 at the outermost edge of body portion 34. Downwardly directed rim portion 34 is typically curved to some degree. As I have previously described them, these flying articles 30 are conventional. However, I have found that by adding a properly positioned element to flying article 30, article 30 will be provided with two enhanced properties. In particular, for example, a piece of ordinary low-density flexible plastic hollow tubing 35, can be attached, via, e.g., glue, to the inside of rim portion 32. The length of tubing 35 will be substantially equal to the inner circumference of rim portion 32 so that tubing 35 can be in contact with and glued to rim portion 32. Hollow tubing 35 provides the following two benefits: (1) allows flying article 30 to float in water due to air trapped within tubing 35 (this is highly beneficial since two of the intended play areas for this game are pools and beaches) and (2) by providing additional mass to flying article 30, it will have improved aerial stability and predictability of flight. While it is known to provide flying disks with elements that provide for improved aerial stability, e.g., U.S. Pat. Nos. 4,940,441, to Novinsky (center weight); 4,906,007, to Mitchell et al. (edge spoilers); 4,315,629, to English (struts and annular lifting surfaces), it is not known to add elements that simultaneously provide for both increased aerial stability and floating ability.

Figure 5:
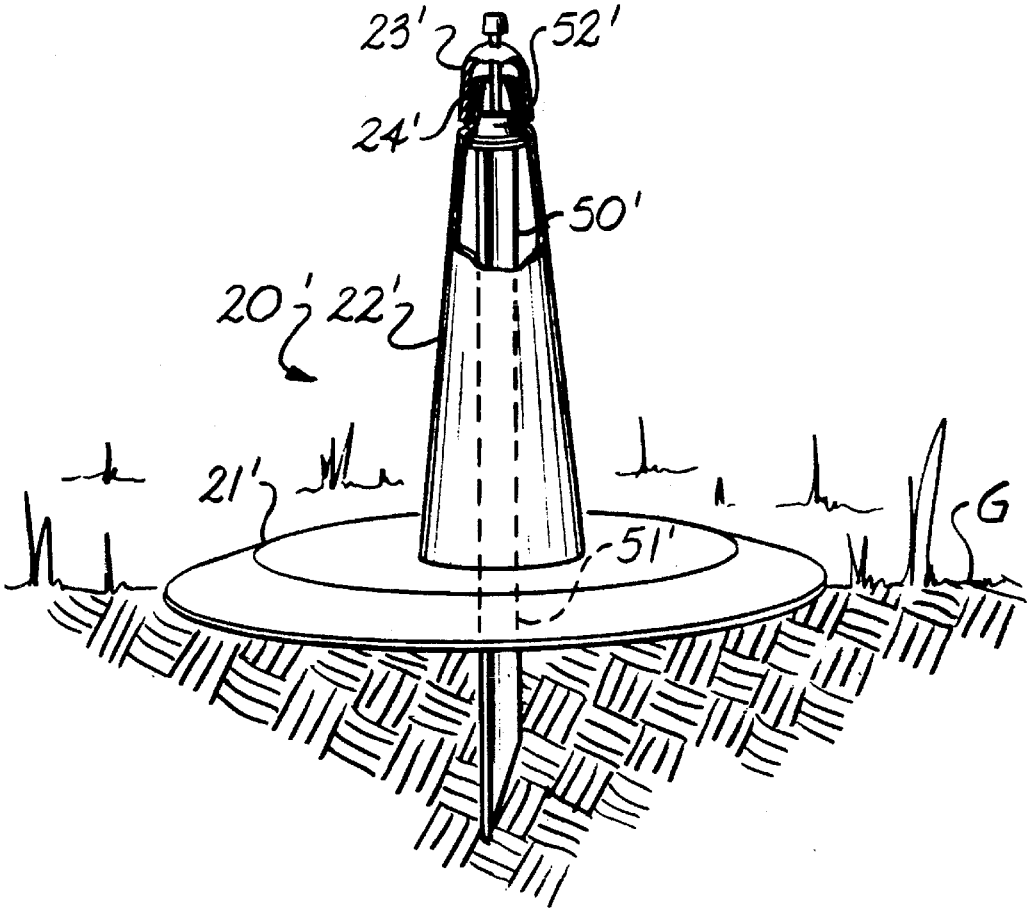
FIG. 5 is a sectional perspective view showing an alternative target embodiment for use with the ring toss game according to the invention.

FIG. 5 shows an alternative construction for the target. This alternative construction allows players to chose a target type dependent upon the playing environment, e.g., playing on concrete verses grass. In this construction, target 20' comprises a unitary construction of circular flange 21', post 22', and tip 23'. Tip 23' covers a smaller tapered portion 24' of post 22'. Spike 50' has spike portion 51' and head portion 52' and is used as the fastening element. The tip of head portion 52' has an outer diameter sized to frictionally fit within the inside of post 22' in the area of ledges 24'. Thus, spike 50' can be inserted into the tapered portion 24' of target 20' so that tent spike 50' and target 20' temporarily become one component. Then, tent spike 50' is driven into ground G for positioning of target 20', i.e., in this embodiment, mat 40 is not needed. Spike 50' is removed from target 20' by merely pulling the two apart. However, it is also possible to optionally provide a button that, when pressed down, pushes head portion 52' out of tapered portion 24'. This optional button would be removable so that it would not interfere with the playing of the game.

Figure 3:
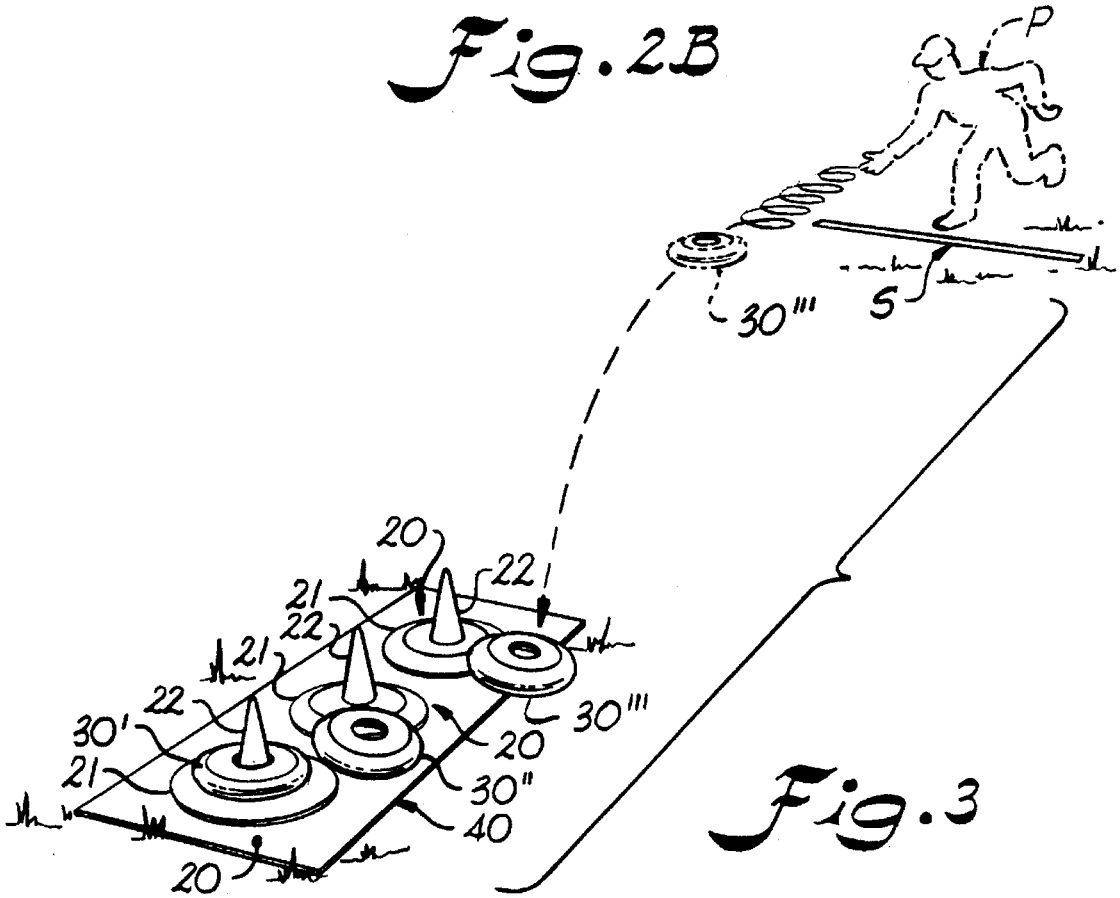
FIG. 3 is a plan view showing various scoring possibilities with the ring toss game according to the invention.

Having described the various components making up the ring toss game according to the invention, how the game is played will now be described with reference to FIG. 3. In particular, FIG. 3 shows three possible outcomes after a player P, standing a predetermined number of feet behind line S, e.g., 10 feet or more, threw three flying articles 30 at targets 20 positioned on mat 40. Mat 40 will have been placed on a playing surface, such as in a swimming pool, on the water at the beach, or on a fixed surface such as a player's backyard. In FIG. 3, the maximum number of points results from flying article 30'. Flying article 30' has come to rest with post 21 of target 20 within center hole 33 of flying article 30. The second highest number of points results from flying article 30". Flying article 30' has come to rest on circular flanges 21 of two adjacent targets 20. The third highest number of points results from flying article 30'". Flying article 33'" has come to rest on circular flange 21 of only one of targets 20. These various point possibilities are not available in products such as the Flying Casino game and, therefore, those types of games may more quickly bore or frustrate players. Finally, the player's discretion and home rules determine whether points are awarded for having flying article 30 come to rest on mat 40 but not in contact with any parts of any of targets 20. Points should be so awarded if the game is played on water because water currents will cause mat 40 to move thereby increasing the skill needed to play the game. Of course, when the embodiment of FIG. 5 is employed, mat 40 is not used as described above.

The above description is given in reference to a ring toss game. However, it is understood that many variations are apparent to one of ordinary skill in the art from a reading of the above specification and such variations are within the spirit and scope of the instant invention as defined by the following appended claims.

That which is claimed:

1. A ring toss game comprising:

at least one flying article having a hole at its center for throwing by a player; and at least one target, said target comprising:

a circular flange having at least one fastening element for assuring said target remains properly positioned, said at least one fastening element comprising a spike;

a post extending upward from said circular flange and having a diameter smaller than that of said hole in said flying article, wherein said spike fits within a tapered portion of said post; and a tip on top of said post, wherein said tip has a button for pushing said spike out of said tapered portion of said post;

whereby a player attempts to position said flying article on said circular flange by throwing said ring-shaped flying article at said target and causing said tip and post to pass through the center of said flying article.

2. A method of playing a game comprising the steps of:

providing at least three stackable and nestable spaced apart targets, each comprising a post supported on and above a circular flange;

providing a mat having fastening elements pre-positioned thereon;

providing a bottom of each of said circular flanges with a complementary fastening element; and fastening each target to said mat in its proper position by securing together said fastening elements of said mat and said circular flanges;

providing and throwing a flying article having a hole at its center at said at least three targets to attempt to pass said post through said hole in said center of said flying article; and providing a re-usable element resistant container for holding the various game parts, said step of providing a re-usable element resistant container for holding the various game parts further comprises:

providing a bucket having a lid, the bottom of said bucket having substantially the same diameter as said circular flange; and further comprising a method of packaging said game comprising the steps of:

stacking and nesting said targets and placing them in said bucket;

wrapping said mat around said circular flanges of said targets; and placing said post of any of said targets through the centers of said flying articles.

3. A game comprising:

a bucket having a bottom and sides, said bucket being resistant to the elements, said bucket further having a lid;

a plurality of stacked and nested targets having a circular flange and an upright post; said circular flange of a lowermost of said targets resting on the bottom of said bucket on the inside thereof;

a plurality of flying articles having holes through their centers, said holes surrounding at least one of said upright posts; and a flexible mat, said flexible mat wrapped around said stacked targets.

4. The game according to claim 3, wherein:

said circular flanges further comprise fastening elements on a bottom side thereof; and said flexible mat further comprise fastening elements on a top side thereof and spaced a predetermined distance apart.

* * * * *